United States Patent [19]

Hoekstra et al.

[11] 4,046,287

[45] Sept. 6, 1977

[54] AUTOMATIC METERING AND DISPENSING SYSTEM

[75] Inventors: Joop Frans Hoekstra, Medfield, Mass.; Donovan Harold Lumby, Minneapolis; William Duncan Vork, Edina, both of Minn.

[73] Assignee: Graco Inc., Minneapolis, Minn.

[21] Appl. No.: 684,680

[22] Filed: May 10, 1976

[51] Int. Cl.[2] ..... B67D 5/10

[52] U.S. Cl. ..... 222/16; 222/309; 141/329

[58] Field of Search ..... 222/307, 308, 309, 136, 222/137, 333, 14, 16; 141/329, 330, 15, 104

[56] References Cited

U.S. PATENT DOCUMENTS

| | | | |
|---|---|---|---|
| 2,380,984 | 8/1945 | Moeller | 141/329 X |
| 2,723,790 | 11/1955 | Speiss, Jr. et al. | 141/329 X |
| 3,029,847 | 9/1958 | Baudhuin et al. | 141/104 |
| 3,052,376 | 9/1962 | Fogg | 222/309 X |
| 3,873,007 | 3/1975 | Christine et al. | 222/309 |

*Primary Examiner*—Stanley H. Tollberg
*Attorney, Agent, or Firm*—Paul L. Sjoquist

[57] ABSTRACT

A system and method for automatically metering and dispensing a plurality of fluids such as paint components is disclosed, including an operator input station for selecting the desired combination of metered fluids, a scanner drive subsystem for positioning a metering unit at appropriate fluid component storage stations, an automatic valving subsystem for controlling the flow of the selected metered component, a metering subsystem having a unit for measuring the proper volume of fluid component to be dispensed, and a dispensing subsystem for feeding the metered quantity into a receptacle. The apparatus may be operated automatically under electrical control of a control subsystem with pre-stored fluid formulations, wherein the desired mixture is identified and the pre-stored formulations enable precise metering of fluid components, or manually where each of the fluid components is manually selected and proportioned by the operator. The respective fluid component storage stations are aligned along a circular arc, and a centrally positioned scanner is rotated so as to contact each of the fluid component storage stations in a pre-selected order, and the fluid at the selected storage station is then metered and dispensed according to the desired formulation. A secondary feature of the invention includes an automatic receptacle positioning apparatus for controlling the positional alignment of the receptacle in correspondence with the fluid component selected.

41 Claims, 12 Drawing Figures

FIG. 1
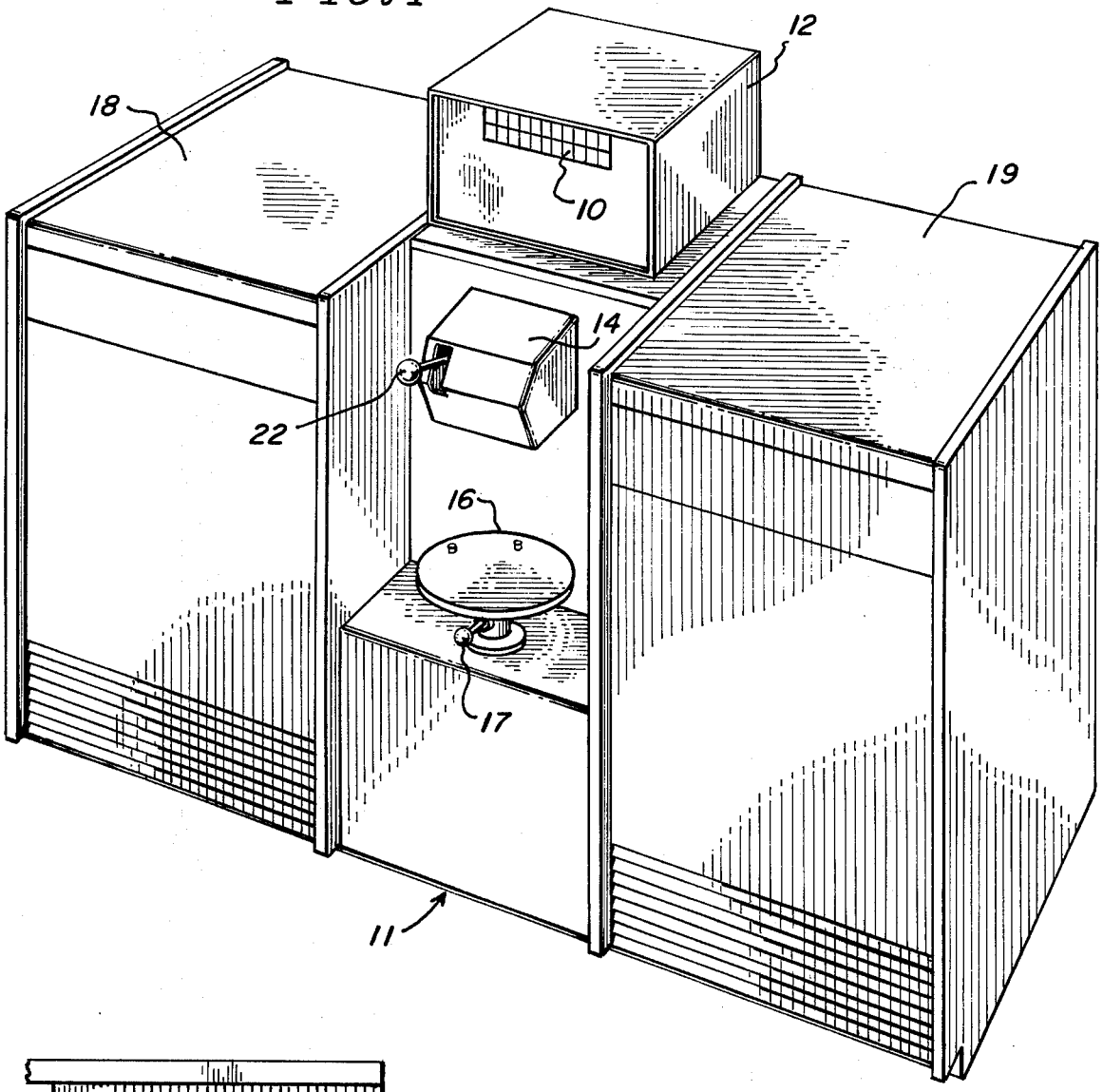
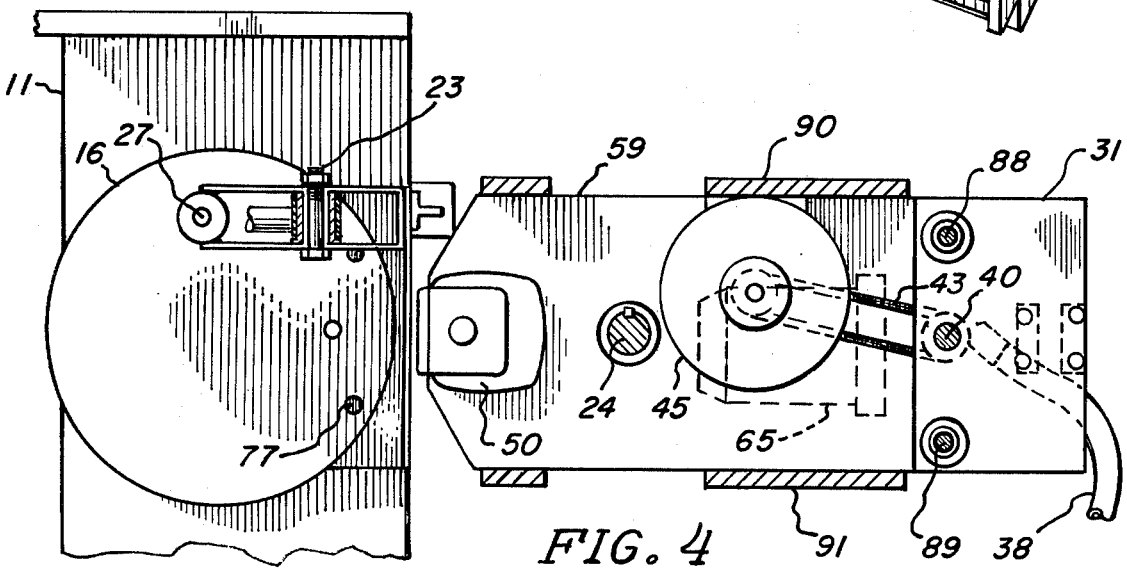
FIG. 4

AUTOMATIC METERING AND DISPENSING SYSTEM

BACKGROUND OF THE INVENTION

This invention comprises a system, and a method for operating the system, for automatically metering and dispensing fluid components such as paint colorant components, according to a predetermined and precise formulation for a desired mixture. Although the preferred embodiment of the invention is directed toward an automatic paint colorant dispenser, it is suitable for metering and dispensing a wide variety of fluid components wherein precise formulations are required in order to obtain a desired mixture.

Automatic metering and dispensing systems have been developed in the prior art using design approaches different from the present invention. For example, U.S. Pat. No. 3,349,962, issued Oct. 31, 1967, discloses a horizontally disposed screw driven metering cylinder arrangement, in which the metering apparatus is operated in conjunction with a card reader to select the desired metered volume of paint. The card reading mechanism requires that the card travel linearly with the screw drive mechanism and the linear travel of the metering screw is controlled by information contained on the card. Metering therefore depends upon a 1:1 relationship between the position of the metering screw and the card.

Other prior art patents show various similar features of the present invention, but none of the prior art devices disclose the advanced technology and novel system control mechanism of the present invention. For example, U.S. Pat. No. 2,796,195, issued June 18, 1957, discloses a metering cylinder connected to a paint container and a three-way valve controlling paint flow to a dispenser.

SUMMARY OF THE INVENTION

The present invention includes a plurality of fluid component valves arranged in a circular path around a central rotatable scanner to form a scanner subsystem which is positionable to select any of the plurality of fluid components. A movable metering subsystem is attachable to each of the plurality of fluid component stations for metering a precise volume of fluid, and a valving subsystem is connectable to each fluid component station for controlling fluid flow for metering and dispensing. A dispensing subsystem is used in conjunction with the foregoing apparatus to provide a plurality of fluid component reservoirs and the means for holding and positioning a receptacle for receiving the metered fluid components. The entire apparatus is electronically controlled by means of a control subsystem including a pre-programmed digital computer, which computer has a manual keyboard input for operator selection of fluid components, and also has an automatic optical reading mechanism for reading bar codes from an appropriate card or color designation chart.

DESCRIPTION OF THE DRAWINGS

A preferred embodiment of the invention is described hereinafter, and with reference to the drawings, in which:

FIG. 1 is an overall front perspective view of the invention;

FIG. 4 is a top view taken along the line 4—4 in FIG. 3;

DESCRIPTION OF THE PREFERRED EMBODIMENT

Figure 2:
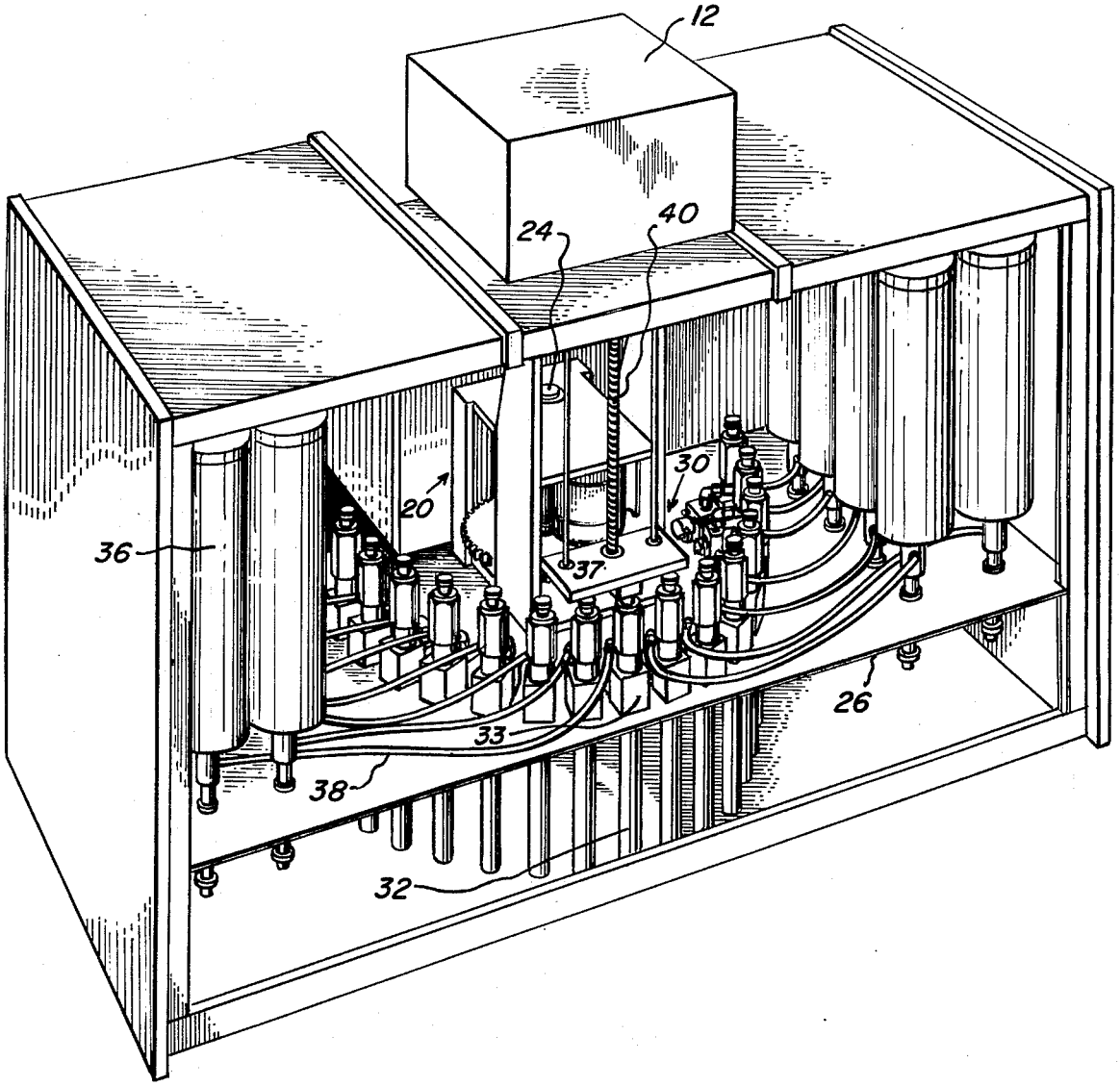
FIG. 2 is a rear perspective view of the invention.

Referring first to FIG. 1, an overall front perspective view of the invention is shown. The main housing in cabinet 11 supports and encloses the inventive elements of the apparatus, and a digital computer 12 is mounted atop cabinet 11. Digital computer 12 has an operator input station 10, comprising a keyboard and light indicators, arranged across its forward face. A fluid dispenser 14 is positioned above a receptacle shelf 16, which shelf is vertically movable to properly position a receptacle under dispenser 14. Shelf 16 is moved by releasing locking handle 17 and raising or lowering the shelf to one of a number of predetermined levels. These levels may relate generally to the respective height of a standard one-quart paint can, a one-gallon paint can, a five-gallon paint can, or similar metric system sizes. Covers 18 and 19 are hinged along their rear edges so that the covers may be lifted to expose the apparatus inside of cabinet 11. This apparatus includes fluid storage cannisters for holding a quantity of various fluids, such as paint colorants, and the canisters may be filled through covers 18 and 19.

A secondary feature of fluid dispenser 14 is a can piercing mechanism, including handle 22. When handle 22 is pushed downwardly, it causes a can piercing mechanism, to be hereinafter described, to come into contact with the top of the receptacle positioned on shelf 16. This can piercing mechanism is aligned so as to properly position the pierced can beneath the fluid dispenser outlet lines.

FIG. 2 is a rear perspective view of the invention with the rear panels removed to show the operative components inside of cabinet 11. A scanner subsystem 20 is centrally positioned and is rotatable about a shaft 24 over approximately a 180° arc. The rotation of scanner subsystem 20 causes a metering subsystem 30 to pass over a circular arc aligned with the positions of a plurality of fluid component storage stations, of which cylinder 32 is typically represented. The cylinders are mounted on a plate 26 which has a circular cutout to enable the scanner subsystem 20 to freely rotate. Each of the cylinders also has a flow control valve, such as valve 34 for cylinder 32, for controlling and directing the flow of fluid component. Projecting from the top of each cylinder is a plunger arm which is connected to a plunger or piston inside the cylinder and which is vertically reciprocable. Plunger arm 37 is typically illustrative of the cylinder plunger arms.

A plurality of fluid component canisters are positioned along the inner left and right side edges of cabinet 11, and are mounted on plate 26. Canister 36 is representative of these canisters, each of which is designated to store a different fluid component.

Canister 36 is connected to flow valve 34 via hose 38, and each of the other canisters are similarly connected to respective flow control valves.

The rotation of scanner subsystem 20 about shaft 24 causes the metering subsystem 30 to be positioned over one of the cylinder plunger arms. For example, FIG. 2 shows metering subsystem 30 positioned over cylinder 32 and valve 34, and in this position it is coupled to plunger arm 37. A drive mechanism, to be described hereinafter, causes threaded shaft 40 to rotate, thereby lifting metering subsystem 30 upwardly.

Since plunger arm 37 is coupled to metering subsystem 30 it also rises, lifting the plunger inside of cylinder 32 upwardly. If valve 34 is then actuated, the fluid component will flow into cylinder 32 via hose 38 from canister 36. The detailed operation of valve 34 will be described hereinafter.

Figure 3:
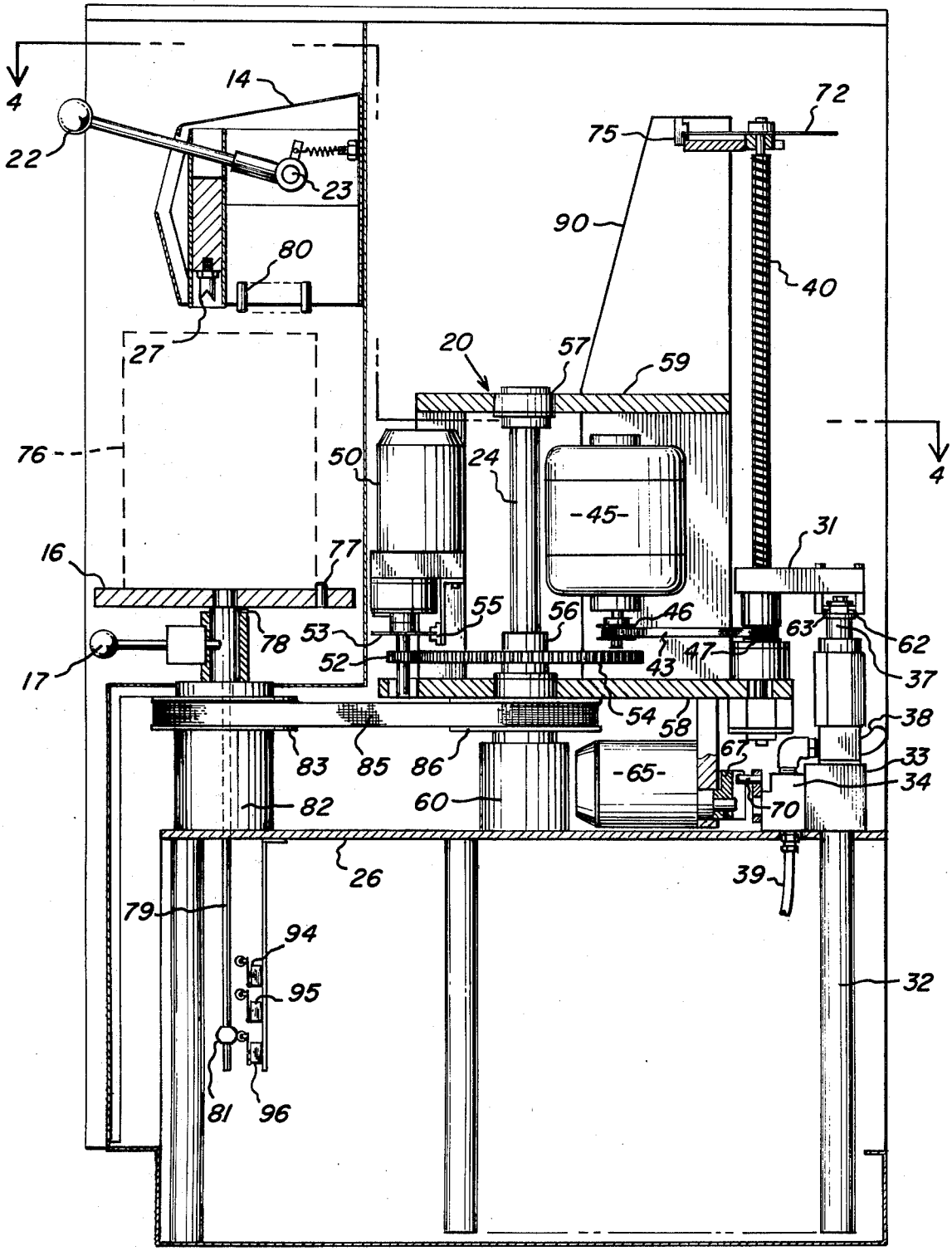
FIG. 3 is a right side elevational view of the invention in partial cross section.

FIG. 3 is a right side elevational view of the invention in partial cross section, showing the scanner subsystem 20 in the same relative position as in FIG. 2. Scanner subsystem 20 is rotated about shaft 24 by drive motor 50. Drive motor 50 has a drive gear 52 affixed to its shaft, which gear is in driving contact with main gear 54. Main gear 54 is rigidly affixed to shaft 24, and scanner subsystem 20 is rotatable about shaft 24 by means of bearings 56 and 57, so that energization of drive motor 50 will cause the entire assembly including plates 58 and 59 to rotate. The entire scanner subsystem is supported on support block 60, which in turn is mounted on plate 26.

Metering drive motor 45 is also attached to scanner subsystem 20 and is rotatable therewith. Metering drive motor 45 is connected to threaded shaft 40 via a belt 43 and pulleys 46 and 47. Energization of metering drive motor 45 therefore causes threaded shaft 40 to rotate, and since drive block 31 is threaded to shaft 40 drive block 31 may be raised or lowered by means of the appropriate directional rotation of threaded shaft 40.

Valve drive motor 65 is also attached to scanner subsystem 20 and is rotatable therewith. Valve drive motor 65 is internally geared to an eccentric 67 and mechanically couples eccentric 68 to valve rod 70. Valve rod 70 is internally coupled to valve 34 to control the internal valve flow passages for directing fluid flow either between cylinder 32 and fluid dispenser 14 or between cylinder 32 and canister 37. Eccentric 67 has a rest position in which it mechanically clears valve rod 70, and in this rest position eccentric 67 may be horizontally moved clear of valve 34 by means of scanner subsystem 20.

FIG. 3 also shows the can piercing mechanism which may be utilized in dispenser 14. Handle 22 is spring biased upwardly about a shaft 23. When it is moved downwardly it slides can piercer 27 downwardly to puncture the top lid of a receptacle held on receptacle shelf 16. When handle 22 is moved upwardly can piercer 27 recesses into dispenser 14.

A typical receptacle 76 is shown in dotted outline in FIG. 3. Receptacle 76 is positioned on shelf 16 by setting it on shelf 16 and sliding it into contact with two locating pins, one such pin 77 being shown in FIG. 3. This positions receptacle 76 properly relative to can piercer 27, and also with relation to the plurality of dispenser outlets, one outlet 80 being illustrated in FIG. 3. If desired, a properly placed electrical switch may also be used to indicate the position of the receptacle. The dispensing outlets are arranged in a circular arc, as will hereinafter be shown, in dispenser 14. The apparatus is designed to rotate the receptacle, by rotating shelf 16 in conjunction with scanner subsystem 20. Shelf 16 is supported by means of a shaft 78 which is seated on a thrust bearing 82. Affixed to shaft 78 is a pulley 83 which is coupled via belt 85 to a second pulley 86 attached to plate 58. Rotation of scanner subsystem 20 causes rotation of pulley 86, which drives pulley 83 and shaft 78. Shaft 78 causes shelf 16 and receptacle 76 to rotate in angular coincidence with the rotation of scanner subsystem 20. Thus, the pierced hole in the top of receptacle 76 is caused to rotate along an arcuate path which places it beneath the proper dispensing outlet corresponding to the angular position of scanner subsystem 20 being coupled to the appropriate cylinder. Each time the scanner subsystem stops in alignment with a particular cylinder the receptacle has its pierced hole aligned beneath the dispensing outlet for that cylinder.

FIG. 4 is a top view taken along the line 4—4 in FIG. 3. Drive block 31 is driven upwardly and downwardly by threaded shaft 40, and is guided in this movement by shafts 88 and 89, which provide a smooth bearing surface for vertical movement but prevent any rotational movememnt of drive block 31.

Metering drive motor 45 is attached to and supported by vertical side wall 90, which is attached to plates 58 and 59. A second vertical side wall 91 provides additional support between plates 58 and 59.

Valving Subsystem

Figure 5C:
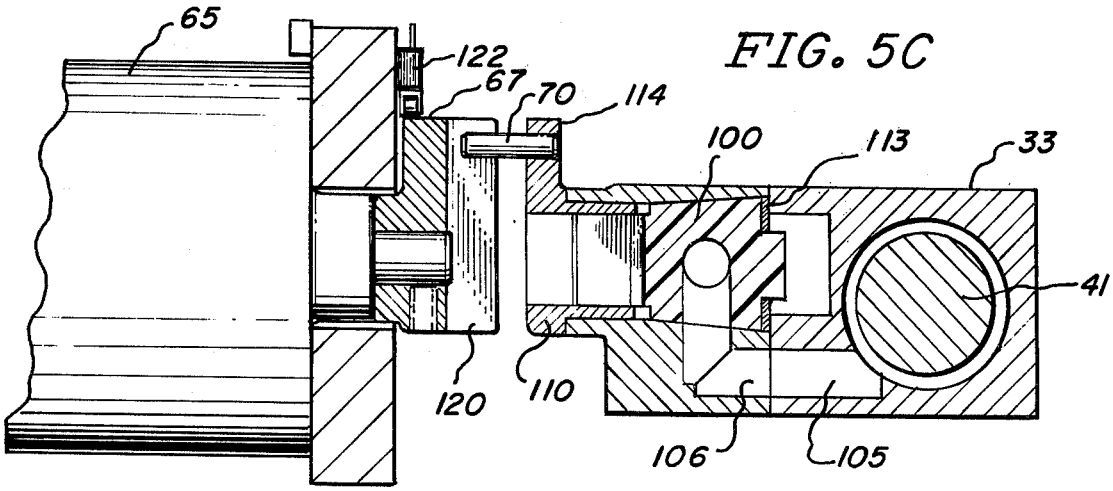
FIG. 5C is a top cross section taken along the line 6—6 in FIG. 5A.
Figure 5A:
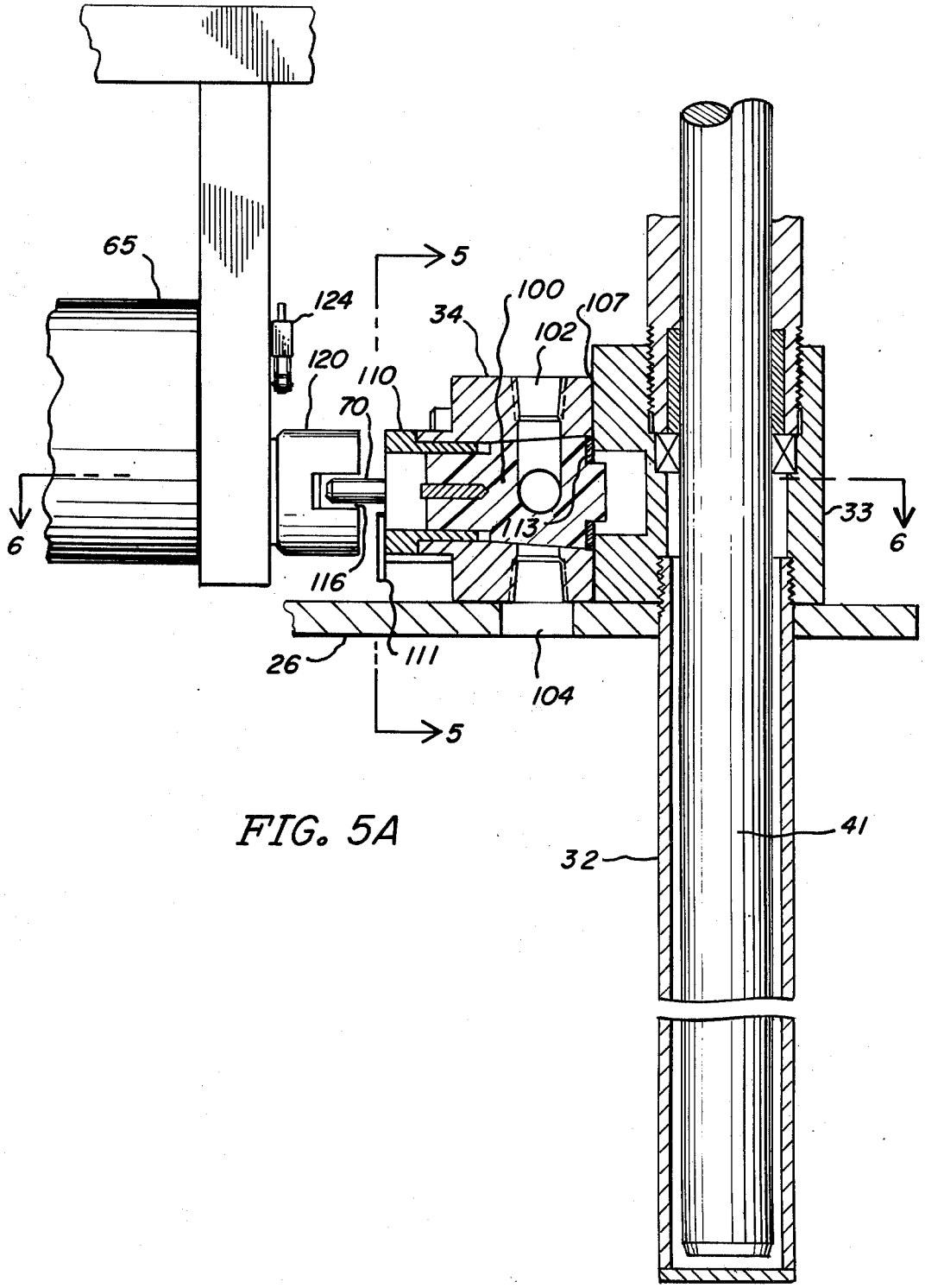
FIG. 5A is an elevational view, in partial cross section, of the metering and valve subsystems.
Figure 5B:
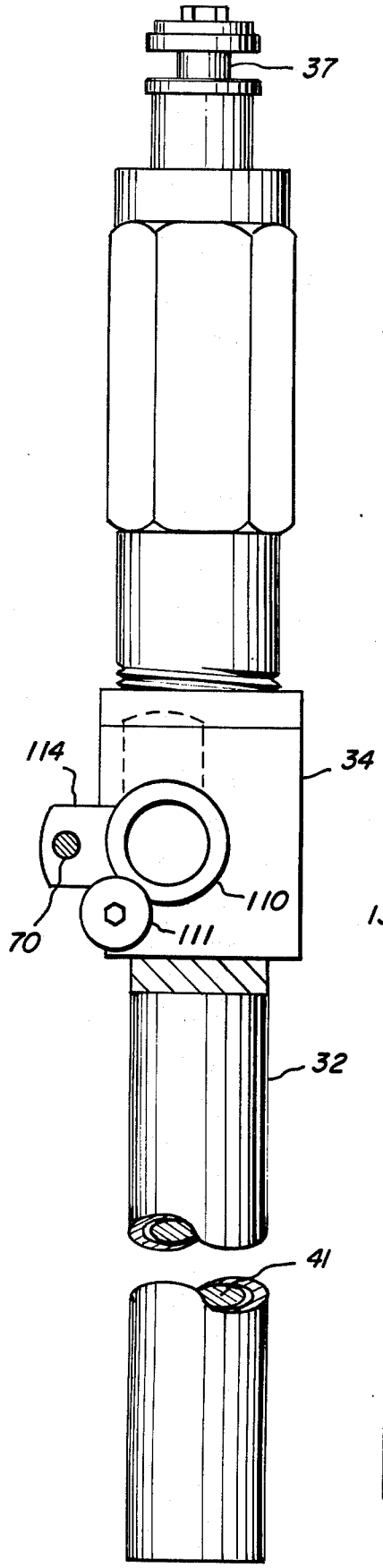
FIG. 5B is a rear elevational view taken along the line 5—5 in FIG. 5A.

FIG. 5A is an elevational view in partial cross section of the flow valve 34 which comprises one essential element of the valving subsystem. Flow valve 34 is attached to plate 26 and cylinder end cap 33.

Valve 34 has a valve port 102 which is connectable to canister 36 via hose 38. A second port 104 in valve 34 is connectable to fluid dispenser 14 via hose 39. A third valve port 106 exits from valve 34 at an angle perpendicular to the flow directions of ports 102 and 104. Port 106 connects to cylinder end cap 33, and particularly to a passage 105 in the end cap. Passage 105 opens into the interior of cylinder 32 to permit fluid flow therein. A gasket 107 provides a fluid seal coupling between valve 34 and end cap 33.

A plug valve 100 is seated in valve 34 in rotatable but fluid sealing relationship. Internal passages in plug valve 100 permit fluid coupling between port 102 and 106 when plug valve 100 is in a first position, and permit fluid coupling between port 106 and port 104 when the plug valve is in a second position. Thus, plug valve 100 may be rotated to provide a fluid passage between canister 36 and the interior of cylinder 32, or it may be positioned for fluid coupling between the interior of cylinder 32 and fluid dispenser 14. A valve stem extension 110 is keyed into the end of plug valve 100 so that rotation of extension 110 will cause plug valve 100 to rotate. A retainer 111 may be screwed into valve 34 to bear against the outer surface of valve stem extension 110 and thereby hold the internal valve assemblies in position. When retainer 111 is tightened against valve stem extension 110, it forces the internal plug valve 100 rearward against valve spring washer 113 to provide a sealable but rotatable coupling. Valve stem extension 110 has a lateral arm 114 which projects off-axis from plug valve 100. Embedded into arm 114 is valve rod 70 which projects in mechanical coupling alignment into a slot 116 in valve actuator 120. Valve actuator 120 is rotatable by energization of valve drive motor 65.

Valve actuator 120 has an eccentric 67 which may come into contact and cause the activation of switches 122 and 124. These switches are of the type known in the industry as micro switches, typically having a cam roller attached to the actuating switch arm. Switch 122 is the "valve home position" switch, and it becomes actuated when valve actuator 120 is in the position shown in FIG. 5C. Switch 124 is the "dispense" switch, and it becomes actuated when valve actuator 120 is perpendicular to the position illustrated in FIG. 5A. Switch 124 provides a signal to indicate that plug valve 100 is positioned for fluid flow between cylinder 32 and fluid dispenser 14. Switch 122 becomes actuated when valve actuator 120 has returned to its "home" position, which is the position required before scanner subsystem 20 can be activated. When valve actuator 120 is in the "home" position clearance is provided in slot 116 for free lateral movement of valve actuator 120 past valve rod 70, which is necessary in order to enable the scanner subsystem to align valve drive motor 65 with the appropriate fluid storage station.

In operation, scanner subsystem 20 first positions valve actuator 120 in alignment with valve 34. Plunger 41 is then retracted by a predetermined distance to admit fluid flow from the canister into cylinder 32. Valve drive motor 65 is then activated to provide a fluid coupling between cylinder 32 and fluid dispenser 14, and plunger 41 is forced downward by a predetermined distance to meter the appropriate fluid quantity to dispenser 14. When the desired quantity has been metered, valve drive motor 65 is again actuated to return plug valve 100 to its original position. Switches 122 and 124 provide an electrical signal to control the operation of valve drive motor 65 and to indicate when the valve has been positioned in either its "home" or "dispense" position.

The foregoing operational sequence assures perfect accuracy in metering and eliminates all errors normally associated with valving inaccuracies in metering systems. Valve 34 is never operated during the actual metering cycle; i.e. during the time that fluid is being dispensed from cylinder 32 to fluid dispenser 14. Thus, turn-on time delays and turn-off time delays attributable to valve 34 do not affect the volume of fluid being dispensed, because valve 34 is positioned before the fluid is dispensed from cylinder 32, and the dispensing of fluid is stopped, by stopping the downward motion of plunger 41, before the valve 34 is actuated into its original position.

Each of the flow control valves operate according to the description just provided. By following a predetermined sequence of steps, it is therefore possible to flow an infinite variety of fluid component mixtures into the fluid dispenser.

Metering Subsystem

Figure 6:
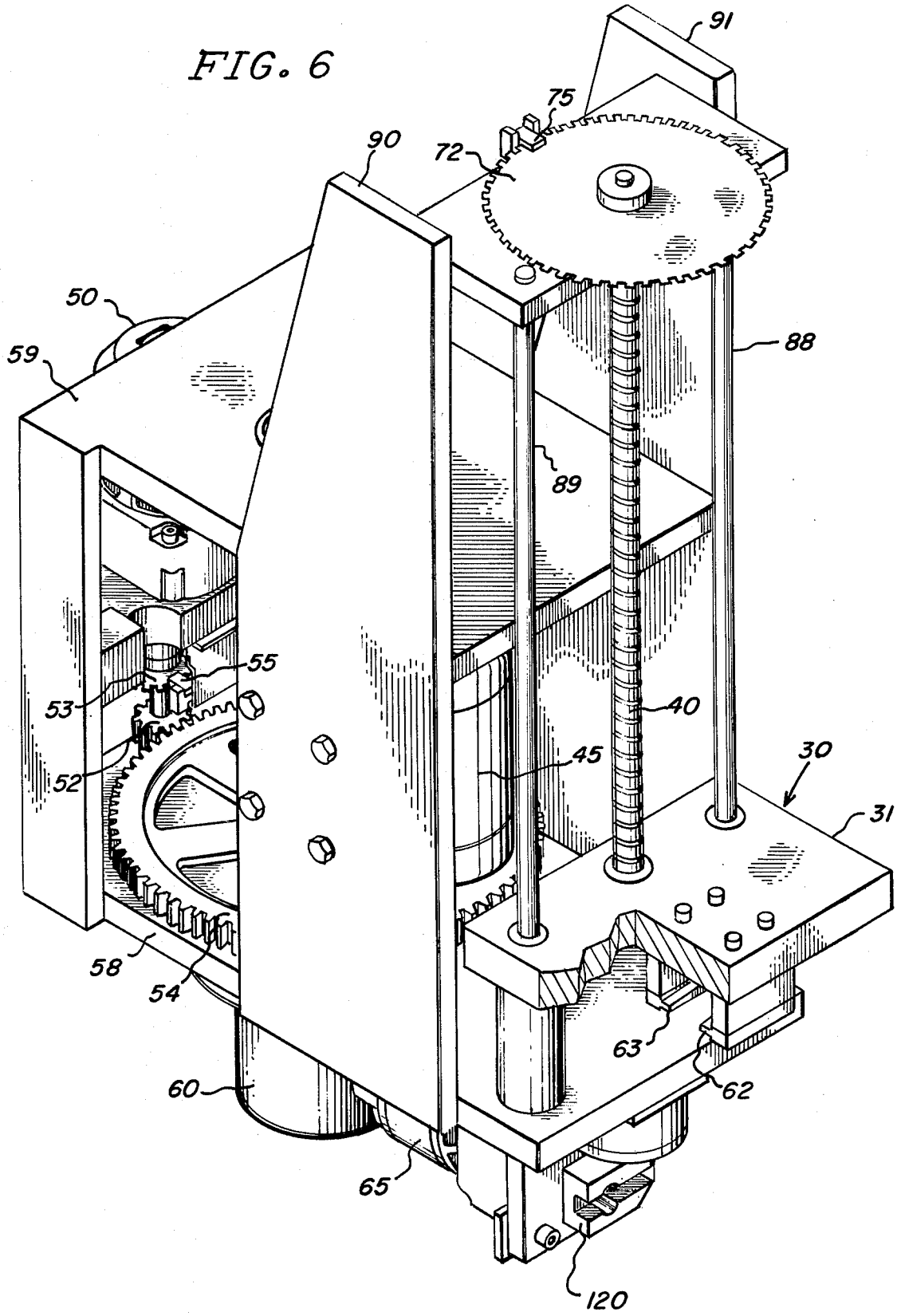
FIG. 6 is a perspective view of the metering subsystem.

FIG. 6 is a perspective view of the metering subsystem 30. It is shown attached to the scanner subsystem 20 which operates via the scanner drive motor 50 and drive gear 52 to rotate about main gear 54. Main gear 54 is attached to a shaft 24, previously described, to cause the entire scanner subsystem 20 to rotate. The metering subsystem, being attached to the scanner subsystem, also rotates about shaft 24 to become positioned adjacent a preselected cylinder. Once this positioning has occurred the metering subsystem is activated to cause a measured amount of fluid to be metered to the dispensing unit.

The metering subsystem is activated by metering drive motor 45, which operates via a toothed belt 43 to rotate a threaded shaft 40. Threaded shaft 40 is threaded through a drive block 31 which forms a part of the metering subsystem 30. Rotation of threaded shaft 40 causes drive block 31 to move upwardly and downwardly, being guided and rotatably constrained by journaled shafts 88 and 89. These shafts provide a smooth bearing surface for guiding drive block 31 upwardly without rotational movement.

Whenever threaded shaft 40 causes drive block 31 to move upwardly or downwardly a pair of gripping shoulders 62 and 63, which nest in the slotted plunger arm 37, cause the plunger arm to move up and down correspondingly. This of course moves the cylinder plunger 41 upward and downward for metering fluid.

A notched disc 72 is attached to the upper end of threaded shaft 40. Disc 72 rotates with shaft 40, and its notched outer periphery passes through an electro-optical reading head 75. Reading head 75 has a light source and photosensitive light cell therein, to generate a light signal which projects through the peripheral notches of disc 72. The photocell in reading head 75 senses the presence and absence of light from the internal light source and generates electrical signals corresponding therewith. These electrical signals are transmitted over suitable wires (not shown) to a counting circuit which counts the number of pulses received and thereby accumulates a count representative of the number of rotations and partial rotations of shaft 40. In this manner, the electrical circuit monitors the vertical position of drive block 31 and hence metering plunger 41. Since the volume dimensions of plunger 41 are known and predetermined, measurement of the vertical position of plunger 41 enables a determination of the volume of fluid which is metered.

In the preferred embodiment, threaded shaft 40 is slightly over 16 inches in length and has 86 thread pitches to provide about 3/16 inch of linear travel of drive block 31 for each revolution of shaft 40. Encoder disc 72 has 157 notches equally spaced around its circumference to provide 157 electrical signals for each revolution of shaft 40, which amounts to a drive block 31 linear travel resolution of about 0.001 inch. The cylinder sizes are selected so that 1/96th ounce of fluid is displaced by a linear movement of the plunger of 0.001 inch, so that the system has an overall fluid metering resolution of 1/96th ounce. One complete stroke of a plunger in a cylinder will displace approximately 140 ounces of fluid, and so the metering accuracy of the system is greater than 1 part in 10,000.

Metering drive motor 45 is a Model NSH55 ¼ h.p. DC electric motor, manufactured by Bodine Manufacturing Company. Motor 45 is a variable speed motor which, in the present invention, has been designed to operate at two speed settings under control of a speed control circuit manufactured by Minarik Company, Los Angeles, Calif. Model W63. Under high speed operation motor 45 drives threaded shaft 40 at about 160 revolutions per minute (rpm) and the slow speed operation is about 1/10th the high speed operation. Each of the motor 45 speed settings are selectable under control of the control subsystem. Under typical operation the control subsystem will select the high speed setting to meter fluid volumes in excess of 0.5 ounces, and will select the low speed setting to meter fluid volumes under 0.5 ounces. If a large fluid volume is to be dispensed the control subsystem will intially select the high speed setting to meter the bulk of the fluid volume very fast, and will switch to the low speed setting to meter the last incremental fluid volume very slowly. This operational sequence assures both high volume delivery efficiency and high accuracy so as to total volume delivered.

In operation, the metering subsystem is first moved into contact with the preselected fluid storage station so that shoulders 62 and 63 are nested in the slotted plunger arm. The control subsystem then activates metering drive motor 45 to cause rotation of shaft 40 and disc 72. Shaft 40 causes drive block 31 to raise vertically and reading head 75 generates electrical signals representative of the vertical distance drive block 31 is raised. The control subsystem stops the vertical movement of drive block 31 when it has raised a distance equal to slightly more fluid volume than is to be dispensed, and then moves drive block 31 back downward a small distance to eliminate any metering inaccuracies caused by mechanical tolerance variations in the drive system. Next, flow valve 34 is rotated to open a fluid flow path between the cylinder and dispenser 14, and the threaded shaft 40 is activated to move drive block 31 downwardly by a precise distance as measured by the electrical signals from reading head 75. When the predetermined fluid volume has been dispensed in this manner, threaded shaft 40 is again stopped and valve drive motor 65 is activated to rotate flow valve 34 to open a fluid flow path between the cylinder and the fluid storage canister, closing the flow path to dispenser 14. The threaded shaft 40 is then restarted to move drive block 31 back to its lowered or rest position. This completes the metering cycle.

Scanner Subsystem

FIGS. 2, 3 and 6 illustrate the elements of the scanner subsystem 20. Subsystem 20 is rotatably mounted on shaft 24 by means of bearings 56 and 57, and is supported on support block 60 by a thrust bearing. Support block 60 is rigidly attached to plate 26, and shaft 24 projects from support block 60 in rigid attachment. Scanner subystem 20 is formed in a rigid housing comprising bottom and top plates 58 and 59 respectively, and rigidly attached side plates 90 and 91. Scanner drive motor 50 is rigidly attached to this housing. Main gear 54 is rigidly fastened to shaft 24, and drive motor 50 is engageable with main gear 54 through a drive gear 52. Thus, activation of scanner drive motor 50 causes entire scanner subsystem to rotate about shaft 24, being driven around the periphery of main gear 54 by drive gear 52.

A notched disc is attached to the motor 50 shaft and rotates therewith. Disc 53 has a notched periphery in the same fashion as hereinbefore explained with reference to disc 72, and optical reading head 55 is mounted about the periphery of disc 53 so that electrical signals may be developed which are representative of the relative angular rotation of disc 53. The principles of operation of disc 53 and reading head 55 are similar to those explained in conjunction with disc 72 and reading head 75. In both cases the electrical signals are connected to the control subsystem wherein a properly programmed digital computer may monitor the relative shaft position of the respective drive motors.

Dispensing Subsystem

Figure 7:
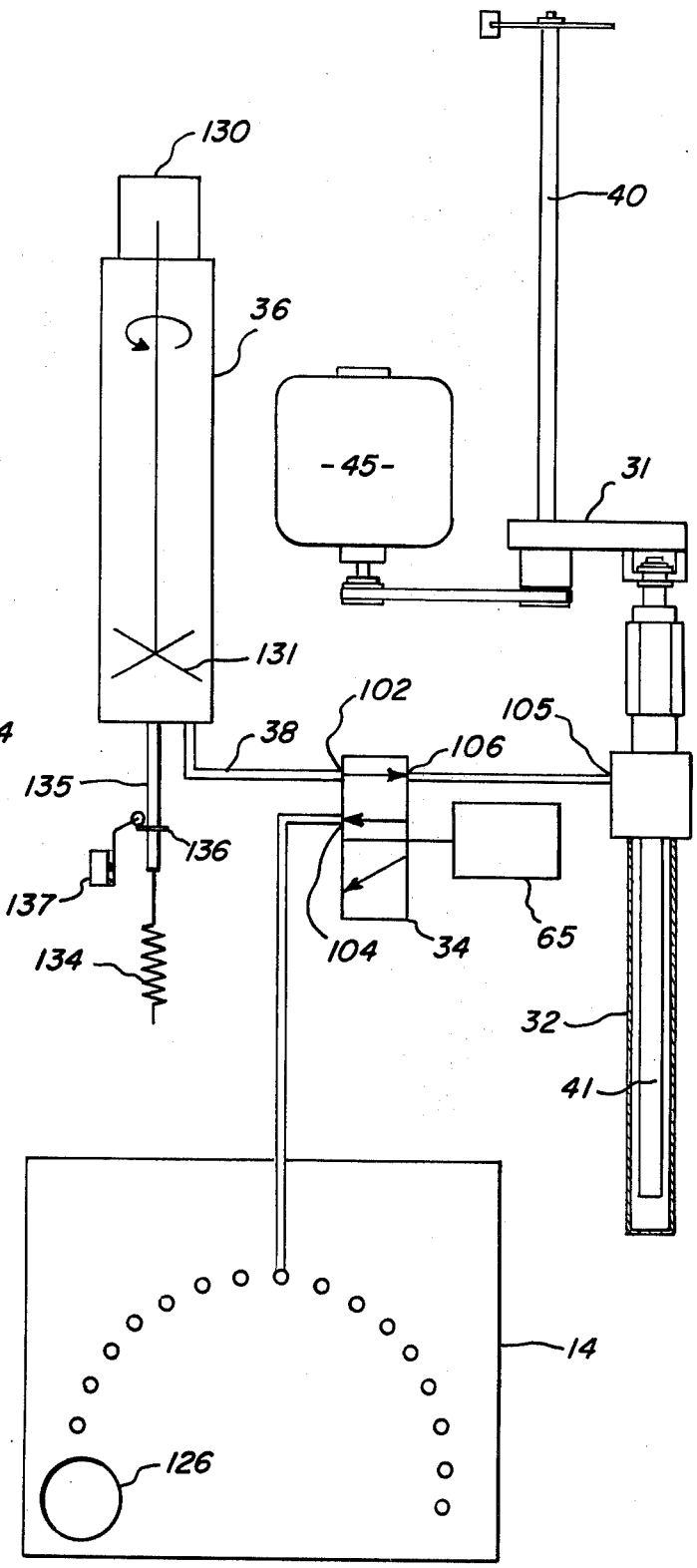
FIG. 7 is a diagrammatic view of the dispensing subsystem.

FIG. 7 is a diagrammatic view of the dispensing subsystem, which comprises a plurality of fluid storage canisters and their respective flow paths to dispensing unit 14. FIG. 7 illustrates a single representative flow path, it being understood that in the preferred embodiment there are 16 different flow paths terminating in dispensing unit 14. The termination ports in dispensing units 14 are arranged along a circular arc corresponding to the angular relationships of the respective scanner storage station positions. The circular arrangement of dispensing ports are positioned so as to coincide with the punched hole in receptacle 76 (see FIG. 3), as receptacle 76 is rotated on receptacle shelf 16 in coincidence with scanner subsystem 20. Pulley 86 is rigidly affixed to plate 58 and rotates therewith. Pulley 86 is coupled via drive belt 85 to pulley 83, which is keyed to shaft 78, to cause a 1:1 rotational arrangement to be imparted to shaft 78 and receptacle shelf 16. Therefore, receptacle 76 rotates in a 1:1 relationship with scanner subsystem 20. The can piercing mechanism is activated when scanner subsystem 20 is in its "home" position, shown as location 126 on FIG. 7, and each of the subsequent scanner 20 positions correspond to a dispenser 14 outlet port.

In FIG. 7, scanner subsystem 20 is shown in the selection position corresponding to canister 36 and flow control valve 34. In this position, a fluid component in canister 36 will flow into cylinder 32 whenever valve 34 is in a first valve position, and will flow from cylinder 32 to dispenser 14 whenever flow valve 34 is in its second position. As hereinbefore explained, flow valve 34 is controlled by a valve drive motor 65.

The dispensing subsystem also includes means for detecting the size of the receptacle which is placed on shelf 16. This is accomplished through the use of a plurality of switches which sense the relative height of shelf 16, which height may be preselected by the operator by pulling handle 17 to disengage a locking detent against shaft 78 so that shelf 16 can be raised or lowered to accommodate the receptacle being used in a particular dispensing operation. A number of predetermined shaft 78 detents are provided so that shelf 16 can be adjusted to hold a number of standard receptacle sizes. An extension 79 projects downwardly from shaft 78 into the region below plate 26. A cam 81 is fixedly positioned along extension 79, and a plurality of sensing switches 94, 95, 96 are located at relative vertical positions to become actuated at shelf 16 heights corresponding to the standard receptacle sizes selected. Thus, if a one-gallon receptacle is to be filled with a predetermined fluid formula, shelf 16 is adjusted so that the receptacle is placed immediately below dispenser 14. This causes cam 81 to actuate one of the switches 94, 95, 96. The switch actuation signal may be electrically connected into the control subsystem to provide a signal indication of the formula volume to be dispensed, and the control subsystem can then calculate the respective fluid component volumes necessary to fill the 1-gallon receptacle with correctly proportioned fluid components. The fluid component volumes determined according to this calculation then form the basis for selecting and controlling the metering subsystem to deliver the fluid through the dispensing subsystem.

A further feature of the dispensing subsystem involves the control of fluid in the storage canisters. Each canister has associated therewith a motor-driven agitation system which may be either manually activated or activated under control of the control subsystem. For example, canister 36 has an agitator motor 130 attached thereto, motor 130 being mechanically coupled to an agitator 131 which is immersed into the fluid stored in canister 36. Whenever motor 130 is electrically activated agitator 131 moves to mix the fluid component.

A further feature of the dispensing subsystem involves the monitoring of fluid components stored in the respective canisters at any given time. Each of the canisters are supported on plate 26 by means of a spring-loaded mechanism. This spring loading mechanism supports the canister at a height which is the function of the volume of fluid contained in the canister. As the fluid is drained from the canister the spring gradually forces the canister upwardly, and this upward movement eventually causes a limit switch to trip, generating an electrical signal to the control subsystem to indicate that the canister fluid volume is low and should be refilled. For example, canister 36 is shown in FIG. 7 symbolically supported by a spring 134, which is connected to canister 36 by means of a support arm 135. A raised cam 136 forms a part of support arm 135, and a limit switch 137 is positioned so as to contact cam 136 whenever support arm 135 moves upwardly to a predetermined position. This position corresponds to a canister 36 weight wherein the fluid volume in canister 36 is nearly depleted. The electrical signal generated by switch 137 controls an indicator alarm which requires refill of the canister, and causes the control subsystem to inhibit further dispensing until refilled.

Control Subsystem

Figure 8:
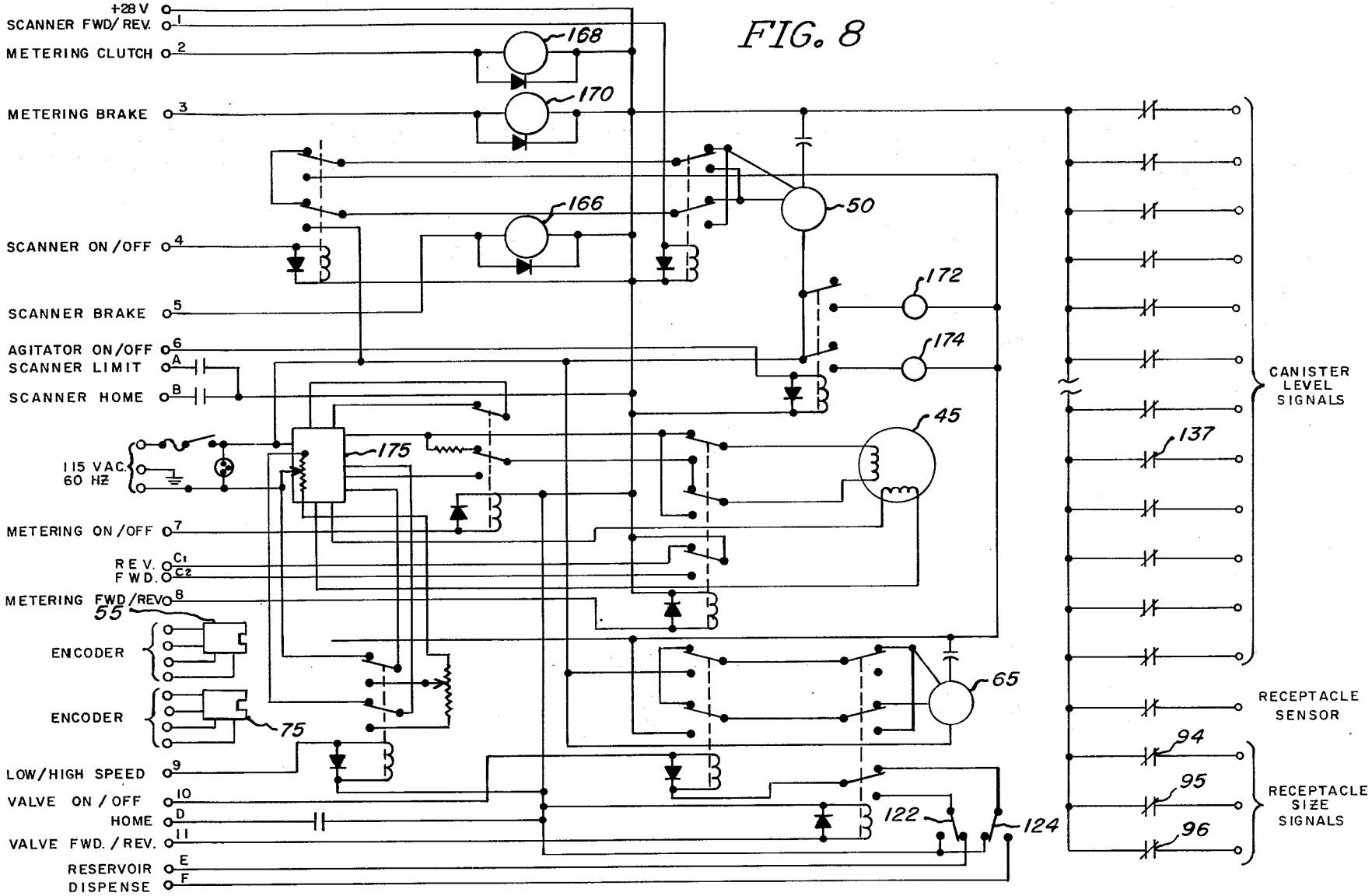
FIG. 8 is a wiring diaphragm of the invention.
Figure 9:
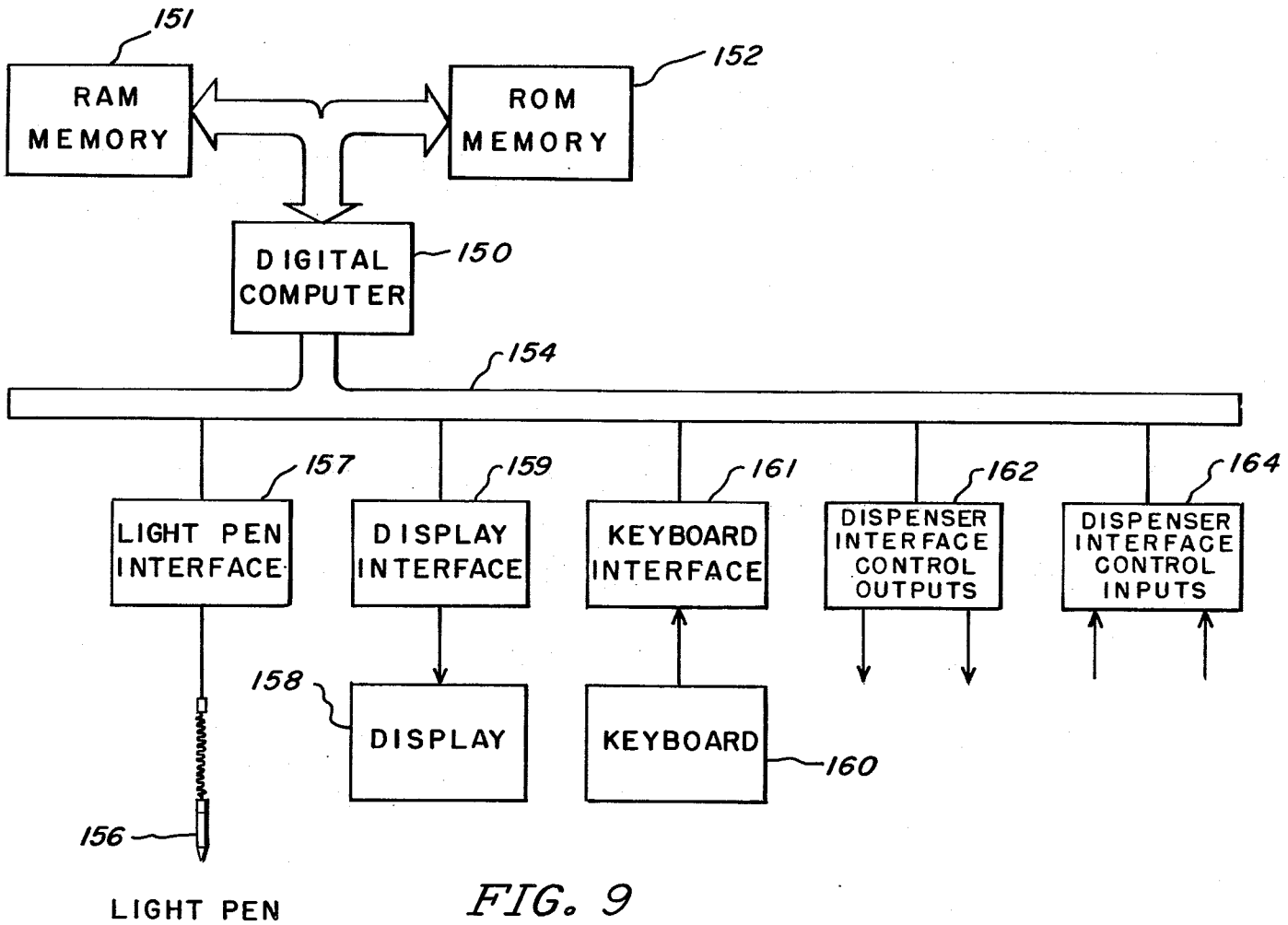
FIG. 9 is a functional block diagram of the control subsystem.

The control subsystem includes the electrical circuits which control the activation of the various motors of the system, and an appropriately programmed digital computer which receives inputs from the system and the system operator makes internal calculations relating to fluid dispensing proportions, and generates output signals for activating the system elements in the proper order. FIGS. 8 and 9 illustrate the various aspects and elements of the control subsystem. FIG. 8 illustrates a wiring diagram of the various motor control circuits. These circuits are activated either by manually operated switches, sensing switches, or by electrical signals from the digital control computer. The activation signals are shown along the left side of FIG. 8 as computer-generated binary signals. These signals originate in a computer output register wherein each register bit position controls a different input line. For illustrative purposes only, each of the signal lines transferring information from the digital control computer to the circuitry of FIG. 8 is numerically designated 1, 2, . . . 11. Similarly, for convenience the signal lines transferring information from the circuitry of FIG. 8 to the digital control computer are alphabetically designated A, B, . . . F. The right side of FIG. 8 illustrates a number of signals developed by sensor switches connected for sensing mechanical positions of various important elements; for example, each of the fluid canisters has a canister sensor switch such as switch 137 (FIG. 7) for detecting when fluid volume reaches a certain minimum level. There may be a number of different receptacle size sensing switches, such as switches 94, 95, and 96, for detecting the position of shelf 16 to determine the size receptacle being used with the invention. Shelf 16 may also have a receptacle sensor switch connected to sense the presence of any receptacle being placed on the shelf. In the preferred embodiment, the receptacle sensor switch must be engaged before the control subsystem will enable dispensing of any fluids.

Signal line 1 transmits a signal from the digital control computer to activate scanner drive motor 50 in either the forward or reverse direction, which is accomplished by the relay circuit illustrated on FIG. 8. Similarly, signal line 4 transmits a signal from the digital control computer to enable the scanner drive motor 50 to be turned on or off, and this signal must be present before the signal on line 1 can be recognized. Scanner motion may be stopped instantaneously by application of a signal on line 5, which activates a scanner brake 166 to mechanically stop the motor 50 shaft.

Signal line 2 transmits a signal from the digital control computer to engage a metering clutch 168, and signal line 3 transmits a signal to engage a metering brake 170. These devices form a part of the metering drive motor housing 45, and comprise electrically actuated brakes and clutches for engaging and disengaging the motor drive shaft. In addition to these signals, metering drive motor may be turned on or off by application of a signal on line 7 and may be moved forward or reverse in direction by application of a signal on line 8.

Signal line 6 transmits a signal from the digital control computer to activate relay circuitry for engaging the agitator drive motors. For purposes of example, circle 172 diagrammatically represents the 8 canister drive motors on one side of the apparatus cabinet, and circle 172 diagrammatically represents the 8 canisters on the other side of the apparatus cabinet. Of course, greater or lesser numbers of agitators and canisters may be provided, and they may be activated in any of a number of prescribed combinations.

Signal line 9 transmits a signal from the digital control computer to actuate relay circuitry which in turn controls a speed control circuit 175. Circuit 175 is a commercially available speed control circuit as hereinbefore described, and serves the function of providing a dual speed drive for metering drive motor 45.

Signal line 10 transmits a signal from the digital control computer to turn on and off valve motor 65. This signal is used in conjunction with the signal on line 11 for controlling the direction of rotation of valve motor 65.

A scanner "home" switch and a scanner "limit" switch are physically positioned to sense the extreme travel points of the scanner mechanism, and these signals are transmitted to the digital control computer over signal lines A and B. The direction of rotation of the metering drive motor is transmitted over signal lines $C_1$ and $C_2$ to the digital control computer. Similarly, the electrical signals generated by reading heads 55 and 75, in combination with their respective disc encoders, are transmitted to the digital control computer for precise calculation of rotational shaft position.

Signal line D transmits a signal through the digital control computer for sensing when the metering subsystem has returned to its lowest or "home" position.

Signal lines E and F respectively send indication signals to the digital control computer to indicate whether the control valve is in the "reservoir" position or "dispense" position. These signals are activated by switches 122 and 124 which are attached to the housing adjacent valve drive motor 65.

FIG. 9 illustrates a block diagram representation of the control subsystem. A central processor 150, which is typically a general purpose digital computer having basic arithmetic and programming capabilities utilized to control the automatic operation of the entire system. Central processor 150 is preferably an 8-bit computer of the type which is generally available in the art, i.e. an Intel Model 8080 general purpose computer. Processor 150 is coupled to a random access memory 151 having a memory storage capacity of about 256 8-bit words. The computer program for operating processor 150 is preferably stored in a read-only memory 152 having a storage capacity of approximately 6,000 computer instructions. A wide variety of commercially available microprocessors may be adapted to meet the control subsystem requirements, the foregoing specific parameters being outlined only as representative of equipment which is well known in the computer field.

Processor 150 has an input/output data channel 154 through which the processor communicates with electrical devices external to the computer. These devices include light pen 156, display 158, keyboard 160, and a number of relay activated switches shown on FIG. 8. Data channel 164 also receives inputs from limit switches and other switches described herein.

Light pen 156 may be a commercially available unit such as models manufactured by Scanomatic Company, Intermec Corporation, and other companies. The light pen is typically used in conjunction with a printed bar code comprising alternate black and white stripes printed on a card. The light pen coverts the light signals received from the black and white stripes to a varying voltage which is converted into a DC pulse chain by light pen interface 157 and transmitted to processor 150. Of course, the printed bar code may be representative of desired fluid component proportions, and in the case of a paint dispenser, the bar code may represent the amount and type of each pigment to be added and mixed to formulate the desired paint color. Optical bar code concepts are known in the art and are particularly adaptable for providing representations of fluid formulations because the bar code formula may be represented for a standard unit volume and the various proportions may be increased or decreased as the size of the receptacle is changed. In the preferred embodiment, a bar code convention is utilized wherein black bars of varying width are separated by intermediate white spaces. The variable width black bars are representative of binary codes which in turn may be translated into decimal numerical representations of interest. A "two out of five" coding convention is utilized wherein five binary digits are presented for each decimal character and wherein the positional significance of two of the five binary digits are representative of the actual decimal number. This code convention is known in the art and is useful in the present invention for conveying the necessary decimal information and providing a self-checking feature on the reading mechanism.

In the bar code format selected for the preferred embodiment, the ends of the bar code pattern are respectively uniquely coded to represent a "start" and a "stop" character. When the light pen is passed over the bar code pattern the digital control computer collects and stores all of the pertinent binary information and searches for the proper "start" code. If no "start" code is detected the digital control computer generates an error indication. The two decimal characters immediately adjacent the "start" code are used to numerically designate the first fluid component canister or storage station to be selected. The next three adjacent decimal characters are representative of the relative proportion of that fluid component which is used in the particular formulation. This five-character fluid identification and volume designation may be repeated up to five times in the preferred embodiment, for it is assumed that no more than five fluid components will be incorporated into any given fluid mixture. However, the invention may easily be adaptable to accept a greater or lesser number of fluid components. After the last fluid component and volume designator a three character check sum is presented. This check sum is a decimal number representative of the sum of all of the numbers contained in the bar code pattern, and it provides a further verification for use by the digital control computer that the signal transmission has been accurate. If the digital control computer calculates a different check sum than the number it reads it generates an error indication and ignores the fluid formulation data which has been read.

Display 158 is typically constructed from light emitting diodes (LED) which may be activated in predetermined combinations to formulate numeric or alphanumeric digits. In the preferred embodiment the display contains six digits which are lit under control of processor 150 to designate the process step in which the system is currently operating and the amount of fluid component being dispensed during this step.

Keyboard 160 comprises a plurality of push button switches arranged in an alphanumeric keyboard pattern to generate coded inputs to processor 150. Keyboard interface 61 contains an electrical scanner which monitors the status of all keyboard switches and generates and binary-coded signal to processor 150 whenever a particular keyboard switch is depressed. The internal program in processor 150 then operates to decode the binary signal received and perform the necessary computer operations required as a result of such signal. Keyboard 160 may be used to provide custom fluid component formulations to the processor or to provide other variable information usable in the control process.

Output interface circuit 162 provides a plurality of electrical signals to control the various subsystems. Each output interface line typically is terminated in a relay switch contact which activates a further electrical circuit for energizing the controlled element. The output signals originate under control of the processor 150 and include the following signals:

A. Metering subsystem and scanner subsystem brake
B. Metering drive motor on/off
C. Metering drive motor forward/reverse
D. Metering drive motor speed selection
E. Scanner drive motor on/off
F. Scanner drive motor forward/reverse
G. Valve drive motor on/off
H. Valve drive motor forward/reverse
I. Agitation motors on/off Interface 164 provides the electrical interface circuitry for receiving switch signals from subsystem elements and converting them to voltage signals appropriate for receipt by processor 150. These input signals include the following:

A. Can size inputs: signals received from switches located on the receptacle shelf for sensing the size of the receptacle being used.
B. Fluid volume level sensing: signals received from switches on each of the fluid canisters to indicate a low fluid volume in the respective canisters.

C. Metering subsystem home switch: a signal received from a switch placed to sense when drive block 31 has been returned to its lowest position, which is defined as the "home" position.

D. Scanner home switch: signal received from a switch placed to sense when the scanner subsystem is positioned in its "home" position, which is the position where the receptacle may be placed on the receptacle shelf and the can punching mechanism activated.

E. Scanner limit switch: a signal received from a switch placed to sense the extreme angular travel position of the scanner, to indicate that scanner has proceeded to the opposite end of its travel limit.

F. Valve position: two switches hereinbefore described for monitoring the flow control valve, to determine whether the valve is positioned for flow communication between a cylinder and a canister, or between a cylinder and dispensing unit.

F. Encoders: signals received from each of the encoder discs, for detecting the relative angular movement of threaded shaft 40 and scanner drive motor; i.e., the metering subsystem encoder generates 20 pulses for each 1/96th of an ounce of fluid component and the scanner subsystem encoder generates 20 pulses for each fluid storage station increment.

The software for controlling the operation of the control subsystem is prestored in the read only memory. It comprises a sequential set of machine instructions which regulate system operation in one of three operational modes. A "custom formula" mode of operation enables the operator to preset in the keyboard the respective fluid component proportions, so that the operator may collect any desired mixture in the container on receptacle shelf 16.

In a "semi-automatic" mode of operation, the operator may preset in the keyboard a formula identification number, which number is then interpreted by the processor, and the processor controls the system to mix the formula components. The formula identification number must be one which has been prestored in the processor and is recognizable by the processor. Further, the components required to mix the selected formula must all be present in their respective canisters for if any needed component is below the low limit volume level in the canister the system will stop and generate an alarm indicator.

Figure 10:
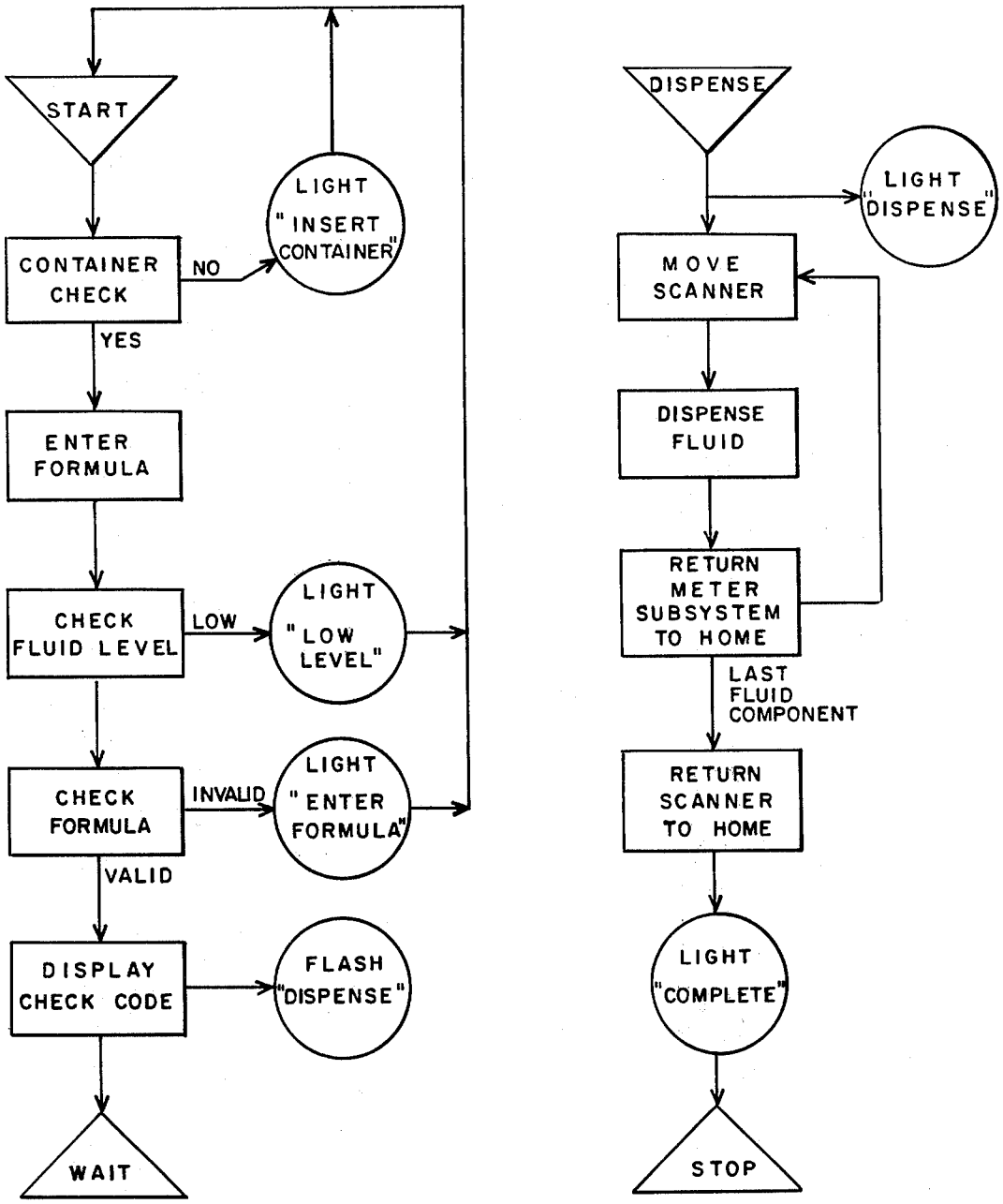
FIG. 10 is a flow chart showing the operational steps of the invention.

A third mode of operation is the "automatic" mode, which utilizes the light pen to read a bar code pattern on preprinted cards and automatically generate the desired formula. FIG. 10 is a simplified flow chart of the automatic mode of operation, wherein the system automatically checks for the presence of a container on receptacle shelf 16, checks the fluid levels in all canisters, checks the formula entered via the light pen, and flashes an indicator to the operator that it is ready to dispense the formula. When the operator depresses the "dispense" push button the system automatically moves the scanner to the first selected fluid component meters and dispenses the desired volume of that fluid component, and returns the metering subsystem back to its home position. The system then automatically continues through each of the other fluid components required to make up the formula, and after completion returns the scanner to its home position. The system then lights an indicator to alert the operator that the dispensing operation is complete.

A further function of the control subsystem is to activate the agitation motors on each of the fluid canisters. These motors are automatically engaged for a period of 30 minutes after the first application of power to the system. They may be manually activated for a period of 10 minutes by pushing an "agitate" push button.

What is claimed is:

1. A fluid component selection and metering apparatus for selecting prestored fluid component formulations and metering fluid components proportioned according to the selected formulations into a receptacle, comprising:

a. means for retaining a plurality of fluid formulations;

b. a plurality of fluid component reservoirs for storing fluid components;

c. a plurality of positive displacement fluid metering pumps arranged along a circular arcuate path, each pump having a vertically movable plunger;

d. a fluid flow valve attached to each of said pumps, said valve having a first fluid flow connection to a fluid component reservoir, a second fluid flow connection to said pump, and a third outlet fluid flow connection;

e. a fluid dispensing housing having fluid flow connections to all of said flow valves' third outlet fluid flow connection;

f. a rotatable scanner having a pivot point radially centered relative to said circular arcuate path and having thereon a metering pump drive system and a fluid flow valve drive system, and also having means for positively coupling said drive systems respectively to a fluid metering pump and a fluid flow valve; and g. means for selecting a fluid formulation and controlling said scanner for selective rotatable connection to positive displacement fluid metering pumps and fluid flow valves corresponding to said selected fluid formulation, and for activating said metering pump drive system and said fluid flow valve drive system to controllably dispense said fluid components through said fluid dispensing housing.

2. The apparatus of claim 1 wherein said metering pump drive system further comprises a motor-actuated screw and a drive block threaded thereto, and said means for positionally coupling further comprises at least one projecting shoulder on said drive block engageable against said vertically movable plunger.

3. The apparatus of claim 2 wherein said fluid flow valve drive system further comprises a motor-actuated slotted shaft engageable against said fluid flow valve.

4. The apparatus of claim 3 wherein said scanner further comprises a fixed shaft radially centered relative to said circular arcuate line and having a drive gear attached thereto, and a motor-driven gear engageable with said drive gear.

5. The apparatus of claim 4, wherein said means for controlling said scanner further comprises means for selectively activating said motor driven gear.

6. The apparatus of claim 5 wherein said plurality of positive displacement fluid metering pumps are arranged at equidistant spacing along said circular arcuate path.

7. The apparatus of claim 6, wherein said fluid metering pump vertically movable plunger further comprises an end having a slotted portion engageable in mating arrangement with said projecting shoulder on said metering pump drive system drive block.

8. The apparatus of claim 7 wherein said scanner further comprises a shaft encoder coupled to said motor-driven gear, said encoder having means for generating electrical signals representative of angular gear position.

9. The apparatus of claim 8 wherein said metering pump drive system further comprises a shaft encoder attached to said motor-actuated screw, said encoder having means for generating electrical signals representative of screw angular rotational position.

10. The apparatus of claim 9, wherein said means for selecting a fluid formulation and controlling said scanner further comprises means for receiving said electrical signals from said scanner shaft encoder and said metering pump shaft encoder, and for generating control signals to selectively activate said motor-driven gear and said motor-actuated screw.

11. A system and apparatus for the automatic selection and proportioning of a plurality of components of a fluid mixture into a single receptacle location, upon the activation of a fluid formula storage device which generates signals representative of fluid component proportions, comprising:

a. means coupled to the fluid formula storage device for generating a plurality of component position signals, by transformation of signals from the fluid formula storage device;

b. a rotatable table and drive means, connected to said means for generating a plurality of component position signals and selectively activated by said component position signals, for angularly and sequentially indexing to a plurality of component positions;

c. a plurality of component metering cylinders fixedly attached in a circular path adjacent said rotatable table at respective component positions, each of said cylinders having a valve and a metering plunger;

d. a linear metering mechanism attached to said rotatable table and coupled to the fluid formula storage device for activation over a predetermined linear distance;

e. means for connecting said linear metering mechanism to said metering plunger;

f. valve activation means, attached to said rotatable table and coupled to said fluid formula storage device, for engaging and activating said valve; and g. a fluid dispensing head in fluid component flow coupling relationship to each of said valves and positioned above said single receptacle location.

12. The apparatus of claim 11, further comprising a plurality of fluid component supply canisters, each respectively connected to a valve in fluid component flow relationship.

13. The apparatus of claim 12 wherein each of said valves further comprises a two-position valve having a first internal flow path coupling said metering cylinder to said fluid component supply canister, and a second internal flow path coupling said metering cylinder to said fluid dispensing head.

14. The apparatus of claim 13 wherein said linear metering mechanism further comprises a rotatable screw seated on said table, a metering arm having threads in threadable relationship to said rotatable screw, and means for rotating said screw a predetermined number of revolutions.

15. The apparatus of claim 14, wherein said rotatable table and drive means further comprises a fixed shaft centrally positioned relative to said metering cylinders circular path, and bearings connecting said table to said shaft for rotatable movement.

16. The apparatus of claim 15, wherein said rotatable table and drive means further comprises a main gear rigidly and concentrically attached to said shaft and a table drive motor attached to said table and geared to said main gear.

17. The apparatus of claim 16, further comprising a shaft encoder attached to said table drive motor, having means for generating electrical signals representative of angular movement of said table drive motor relative to said main gear.

18. The apparatus of claim 17, further comprising means for receiving said shaft encoder signals and said component position signals, and for activating said table drive motor in response to predetermined differences between said signals.

19. A fluid selection apparatus for selecting any of a plurality of fluid components held in respective reservoirs for fluid coupling to a single receptacle, comprising:

a. a plurality of fluid valves arranged along a circular path, each valve respectively fluid coupled to a reservoir and having a valve actuating arm projecting therefrom;

b. a single dispensing head fluid coupled to all of said fluid valves and to said receptacle;

c. a fixed shaft axially positioned at the center of said circular path;

d. a housing rotatably mounted on said shaft;

e. a gear rigidly and concentrically attached to said shaft;

f. a drive motor attached to said housing and mechanically coupled to said gear;

g. mechanical linking means, attached to said housing and projecting radially toward said circular path, for attaching to said valve actuating arms; and h. drive means for moving said mechanical linking means, said drive means being attached to said housing, whereby rotation of said housing into radial alignment with one of said fluid valves and activation of said drive means permits fluid flow.

20. The apparatus of claim 19, further comprising encoder means coupled to said drive motor for generating electrical signals representative of housing angular rotation.

21. The apparatus of claim 20, further comprising control means connected to said encoder means and said drive motor for receiving said encoder electrical signals and for activating said drive motor in response thereto to radially position said housing.

22. The apparatus of claim 21, wherein said mechanical linking means further comprises a rotatable collar having a slotted facing surface.

23. The apparatus of claim 22, wherein said valve actuating arm further comprises a crank arm sized to fit in said slotted facing surface.

24. The apparatus of claim 23, wherein said drive means comprises an electric motor connected to said control means.

25. The apparatus of claim 24, wherein said encoder means further comprises a notched disc rotatably coupled to said drive motor and a sensor attached to said housing for detecting movement of said disc notches.

26. The apparatus of claim 25, further comprising an electrical limit switch positioned at one end of said fluid valves' circular path, in mechanical switch-activating contact with said housing, said switch being electrically connected to said control means.

27. A fluid metering apparatus for metering a predetermined fluid volume from a fluid reservoir to a dispenser, comprising:

a. a three-way valve having a first outlet coupled to said reservoir, a second outlet coupled to said dispenser, and a third outlet internally valvable to either said first or second outlet;

b. a cylinder coupled to said third valve outlet;

c. a plunger slidably fitted into said cylinder;

d. a rotatable threaded screw movable into parallel adjacent position with said plunger;

e. a drive block threadably attached to said screw and extending to said plunger, including means for gripping said plunger;

f. means for rotating said threaded screw in two angular directions;

g. encoder means, coupled to said rotatable threaded screw, for generating electrical signals indicative of said screw angular rotation; and h. control means connected to receive said signals and connected to said means for rotating said threaded screw, for selectively energizing said means for rotating as a function of said electrical signals.

28. The apparatus of claim 27, further comprising means for selectively presetting said control means for a predetermined number of rotations of said threaded screw, and wherein said control means includes means for continuously comparing said encoder electrical signals with said selective preset to deenergize said means for rotating upon the occurrence of a comparison coincidence.

29. The apparatus of claim 28, wherein said plunger further comprises a peripheral slot and said drive block means for gripping further comprises a pair of facing shoulders spaced for engagement into said slot.

30. The apparatus of claim 29, wherein said encoder means further comprises a notched disc concentrically attached to an end of said threaded screw, and an optical reading head coupling said notches for sensing disc angular movement.

31. The apparatus of claim 30, wherein said control means further comprises a programmed digital computer, and said means for selectively presetting further comprises an optical light pen in combination with a coded printed pattern representative of said preset.

32. A fluid dispensing apparatus for dispensing a plurality of fluid components into a single receptacle opening, comprising:

a. a circular table for holding said receptacle in a predetermined position;

b. a piercing means for making a single opening in said receptacle at a predetermined position;

c. a plurality of dispensing outlets, each fluid-coupled to receive a fluid component, arranged along a circular path above said receptacle, said circular path having its origination point at the position of said piercing means; and d. means for selectively rotating said circular table to position said single opening below any of said dispensing outlets.

33. The apparatus of claim 32, further comprising control means for selectively actuating fluid flow in said dispensing outlets, said control means also connected to activate said means for selectively rotating said circular table.

34. The apparatus of claim 33, wherein said piercing means further comprises a pointed shaft recessable in a passage above said receptacle, and a handle means connected to said pointed shaft for raising and lowering said pointed shaft.

35. The apparatus of claim 34, further comprising means for selectively raising and lowering said circular table.

36. The apparatus of claim 35, further comprising a single rotatable shaft rigidly connected at a first end to said circular table, and said means for selectively rotating said circular table further comprises an electrical motor drivingly coupled to said rotatable shaft.

37. The apparatus of claim 36, wherein said control means further comprises electrical circuits for energizing said electric motor for rotation in two angular directions.

38. The apparatus of claim 37, wherein said control means further comprises a programmed digital computer.

39. A method of metering a precise fluid volume by mechanically raising and lowering a metering plunger in a cylinder in cooperation with a fluid valve for admitting fluid into the cylinder from a reservoir in a first valve position and admitting fluid from the cylinder to a dispenser in a second valve position, comprising the steps of:

a. setting the fluid valve to its first position;

b. raising the plunger to a first predetermined level;

c. lowering the plunger to a second predetermined level;

d. setting the fluid valve to its second position;

e. lowering the plunger to a third predetermined level; and f. setting the fluid valve to its first position.

40. The method of claim 39, further comprising the step of lowering the plunger to a fourth predetermined level.

41. The method of claim 40, wherein step c) further comprises lowering the plunger to a second predetermined level which is only slightly below said first predetermined level.

* * * * *